United States Patent [19]

Norton

[11] 4,114,881

[45] Sep. 19, 1978

[54] BALL RETRIEVER

[76] Inventor: David A. Norton, 1328 S. Michigan Ave., Clearwater, Fla. 33516

[21] Appl. No.: 770,992

[22] Filed: Feb. 22, 1977

[51] Int. Cl.[2] ..... A63B 69/38

[52] U.S. Cl. ..... 273/73 R

[58] Field of Search ..... 273/73 R, 73 C, 73 J, 273/162 E; 294/19 R, 19 A; 46/DIG. 1

[56] References Cited

U.S. PATENT DOCUMENTS

| | | | |
|---|---|---|---|
| 266,598 | 10/1882 | Alexander | 273/73 R |
| 1,540,823 | 6/1925 | Mairhofen | 273/73 R X |
| 1,658,145 | 2/1928 | Uyei | 273/162 E X |
| 3,007,726 | 11/1961 | Parkin | 273/73 R X |
| 3,442,544 | 5/1969 | Faber | 294/19 A |
| 3,874,666 | 4/1975 | Ross | 273/73 R |
| 4,045,068 | 8/1977 | Nelson | 294/19 A |

FOREIGN PATENT DOCUMENTS

| | | | |
|---|---|---|---|
| 2,254,275 | 11/1973 | Fed. Rep. of Germany | 273/73 R |
| 480,051 | 4/1951 | Italy | 273/73 R |
| 207,138 | 11/1923 | United Kingdom | 273/162 E |

*Primary Examiner*—Richard J. Apley

*Attorney, Agent, or Firm*—Duckworth, Hobby, Allen & Pettis

[57] ABSTRACT

A ball retriever of the type primarily intended for use in picking up tennis balls, comprising a handle, a base mounted on one end of the handle, and a clip operatively attached to the base in ball-engaging relation to the surface of the tennis ball. The clip of the present invention includes a plurality of hooks disposed in nap-engaging relation to the tennis ball surface. Upon being engaged by the ball retriever of this invention, a tennis ball is held therein until removed by pulling.

5 Claims, 4 Drawing Figures

BALL RETRIEVER

BACKGROUND OF THE INVENTION

1. Field of the Invention

The present invention relates to a ball retriever device specifically designed and constructed for grippingly engaging and retaining a tennis ball. The device comprises a handle which may be provided by the tennis racket handle, a base means which is preferably mounted at the butt end of the tennis racket, and clip means attached to the base means. Predetermined portions of the clip means define a plurality of hook means which engage the fuzzy surface of a tennis ball so that it can be picked up without the necessity of stooping.

2. Description of the Prior Art

Devices specifically designed for grasping or retrieving spherical objects are well known in the prior art. Such devices take a wide variety of configurations, and are intended for use with such diverse items as pecans and golf balls. One such device is taught by U.S. Pat. No. 266,598 to Alexander. The Alexander apparatus discloses the use of spring arms which are pushed against a tennis ball. The arms will pass over the ball and grasp the ball within the spring-loaded arms. However, since the Alexander arms must reach past the midpoint of the tennis ball, the arms are quite lengthy and cumbersome when attached to the end of the tennis racket.

Similar ball-retaining devices are disclosed in U.S. Pat. Nos. 1,380,526; 1,830,520; and 2,968,509. Each of these patents teaches the construction and use of devices primarily intended for picking up golf balls. Certain ones of these ball retrievers comprise a plurality of spring-like arms defining a cage. As the arms are passed over the golf ball, the spring-like arms return to their original position defining a flexible enclosure for the retained balls. Others disclose a rubber ring that fits tightly around the upper part of a golf ball and grippingly engages the ball's indented surface.

In light of this prior art, it is quite apparent that numerous ball retriever devices are well known. However, most such devices are relatively cumbersome. That is to say, most such devices comprise an article of manufacture quite separate and distinct from any of the other implements utilized in sporting events such as tennis rackets, golf clubs, or other ball-striking devices. It is, therefore, apparent that there is a great need in the art for a simple, unobtrusive device which can be utilized to grip and retain a spherical playing object. More specifically, there is a particular need for a device which can be utilized to pick up tennis balls. Such a ball retainer would preferably be attachable to the base of a tennis racket, without impeding the normal use of that racket. Further, such a ball retaining device would preferably be constructed so as to make use of the natural, fuzzy exterior of a tennis ball in picking it up.

As with all articles manufactured, it would be desirable if the ball retainer were of relatively simple construction so that it could be economically produced and sold to the consuming public. Further, the device should be constructed so that it may be added to existing tennis rackets as well as being built into the handle of future rackets. Finally, it is clear that there is a great need in the art for a device specifically designed to grip and retrieve the relatively soft, fuzzy surface of a tennis ball.

SUMMARY OF THE INVENTION

The present invention relates to a ball retriever primarily intended for use in picking up tennis balls. The retriever comprises handle means which, in the preferred embodiment, comprises the handle of a tennis racket. A base means comprising a protective cup is attached to the butt end of the tennis handle, and clip means are mounted within the base means. As will be described in greater detail hereinafter, the base means is defined by a frustrum of a right cone, the smaller side of which is closed. It is this closed side which is attached to the butt end of the tennis racket. Accordingly, the base means defines an open cup at the butt end of the racket handle.

The clip means of the present invention comprises a plurality of radially extending arms, and the free ends of those arms extend toward the open larger side of the base means and include a plurality of hook means formed on their free ends. These hook means are disposed in nap-engaging relation to the fuzzy surface of a tennis ball.

The arms of the clip means of the present invention are formed from a resilient material so as to deform along the surface of the tennis ball and positively engage the hook means with the ball's nap. While the hook means of the present invention may comprise pointed segments of the same material from which the clip means is formed, the hook means may also comprise sections of Velcro tape. Of course, it should be obvious that if the Velcro material is utilized, it must be the hook-type Velcro and not the loop material.

For simplicity of construction, the base means of the present invention includes a plurality of tips formed on the interior thereof. The clip means comprises a corresponding plurality of apertures formed therethrough in corresponding relation to the base means tips. The clip means is attached to the base means by press-fitting the two elements together. This is accomplished by inserting each of the tip means through corresponding ones of the apertures formed in the clip means.

The ball retriever device may be attached to a handle means in either of two fashions. First, the butt end of the grip may be predrilled to accept the base means therein. The size and configuration of the pre-drilled hole would correspond to the frustrum defining the base means, and the base means would simply be adhesively secured therein. Second, the base means could be directly attached, as by an adhesive material, directly to the planar end of the tennis racket grip. This would result in the ball retriever device extending slightly beyond the end of the grip. However, this would not detract from the usefulness of the racket for the reason that the ball retriever is extremely lightweight, and is of a diameter equal to or less than that of the racket grip. Accordingly, even if mounted on the flush end of an undrilled tennis grip, the retriever of the present invention would not interfere with normal use of the racket.

Having thus attached the ball retriever to its handle means, it should be obvious that the device is utilized by simply pressing the clip means into contact with the fuzzy surface of a tennis ball. The hook means will engage the nap of the ball, allowing the user to pick the ball up from the court surface without the necessity of stooping or bending.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
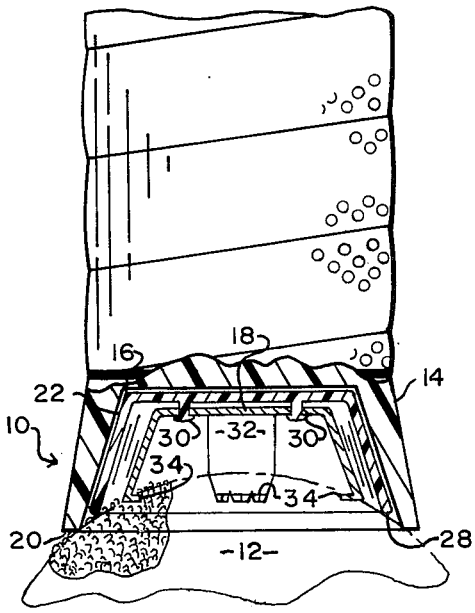
FIG. 1 is an elevation view, partially in section, showing a tennis ball held by the ball retriever of the present invention.

The ball retriever of the present invention is generally indicated as 10 in the view of FIG. 1, and is shown therein operatively gripping a tennis ball 12. As shown in the view of FIG. 1, retriever 10 basically comprises a handle means 14, a base means 16, and clip means 18. In the preferred embodiment, handle means 14 comprises the butt end of a tennis racket grip. As best seen in the view of FIG. 1, butt end 20 of the handle means 14 is drilled to define an aperture 22 which corresponds to the configuration of base means 16, and receives base means 16 therein.

Figure 2:
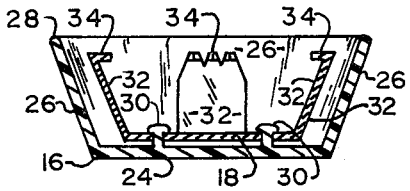
FIG. 2 is a sectional view taken along line 2—2 of FIG. 3.

As best seen in the sectional view of FIG. 2, base means 16 is defined by a frustrum of a right cone. Smaller side 24 of base means 16 is closed and integrally formed in interconnecting relation across base means side wall 26. Opposite end 28 of side wall 26 defines the perimeter of the open larger side of base means 16.

As will be described in greater detail below, base means 16 further comprises a plurality of tip means 30 formed on the interior of small side 24 and extending substantially perpendicular thereto.

Figure 3:
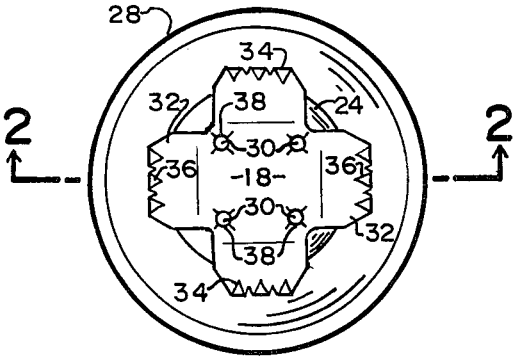
FIG. 3 is a plan view of the ball-engaging side of the present invention.
Figure 4:
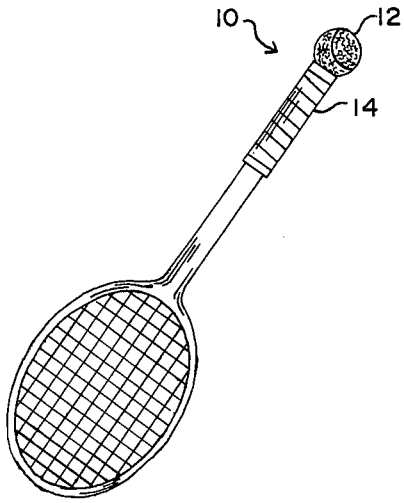
FIG. 4 is a plan view of a tennis racket holding a tennis ball in the retriever of the present invention.

Clip means 18 is preferably formed from a resilient material and comprises a plurality of radially extending arms 32. Arms 32 are turned so as to extend in substantial parallel relationship to side wall 26. Free ends 34 of arms 32 comprise a plurality of hook means disposed in nap-engaging relation to corresponding portions of the surface of tennis ball 12. As best seen in the plan view of FIG. 3, the hook means may comprise teeth 36. Alternately, the hook means may comprise a strip of hook-type Velcro tape (not shown).

Finally, clip means 18 further comprises clip apertures 38 dimensioned and configured for receiving, locking engagement with tip means 30 formed on base means 16. By virtue of this construction, clip means 18 may be attached to base means 16 by press-fitting tips 30 through apertures 38. Base means 16 may then be attached to handle means 14 as shown in the view of FIG. 1. Alternatively, base means 16 may be attached directly to a planar, non-drilled handle means 14.

In operation, the player simply presses butt end 20 of his tennis racket against ball 12. By virtue of the resilient nature of clip means 18, arms 32 spread outwardly toward side wall 26. Hook means such as teeth 36 then graspingly engage and entangle themselves in the nap present on the surface of the tennis ball 12. Ball 12 is retained in retriever device 10 by this entanglement until pulled therefrom by the user.

It will thus be seen that the objects set forth above, among those made apparent from the preceding description, are efficiently attained, and since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A ball retriever primarily intended for use in picking up tennis balls, said retriever comprising: handle means; base means attached to one end of said handle means; and clip means attached to said base means, predetermined portions of said clip means being in engaging relation to corresponding portions of the surface of the tennis ball to be picked up, wherein said base means is defined by a frustrum of a right cone, the smaller side of said frustrum being closed and attached to said one end of said handle means and the larger side of said frustrum being open, said base means further comprising a plurality of tip means formed on the interior of said smaller frustrum side and a corresponding plurality of clip apertures being formed in said clip means whereby said clip means is attached to said base means by inserting each one of said tip means through a corresponding one of said clip apertures, said clip means further comprising a plurality of radially extending arms, the free ends of said arms extending toward said open larger side and having formed thereon said predetermined portions a plurality of hook means disposed in nap-engaging relation to said corresponding portions of said tennis ball surface.

2. A ball retriever as in claim 1 wherein said handle means comprises a tennis racket and said one end comprises the butt of the grip of said tennis racket.

3. A ball retriever as in claim 1 wherein said clip means is formed from a resilient material.

4. A ball retriever as in claim 1 wherein said hook means comprise teeth.

5. A ball retriever as in claim 4 wherein said teeth define a plane substantially parallel to said open larger side within said frustrum.

* * * * *